US011362416B2

(12) United States Patent
Liang et al.

(10) Patent No.: US 11,362,416 B2
(45) Date of Patent: Jun. 14, 2022

(54) LIQUID CRYSTAL ANTENNA AND ITS MANUFACTURING METHOD

(71) Applicants: Beijing BOE Technology Development Co., Ltd., Beijing (CN); BOE TECHNOLOGY GROUP CO., LTD., Beijing (CN)

(72) Inventors: Kui Liang, Beijing (CN); Tuo Sun, Beijing (CN)

(73) Assignees: Beiing BOE Technology Development Co., Ltd., Beijing (CN); BOE TECHNOLOGY GROUP CO., LTD., bEIJING (CN)

( * ) Notice: Subject to any disclaimer, the term of this patent is extended or adjusted under 35 U.S.C. 154(b) by 0 days.

(21) Appl. No.: 16/912,506

(22) Filed: Jun. 25, 2020

(65) Prior Publication Data

US 2021/0091460 A1 Mar. 25, 2021

(30) Foreign Application Priority Data

Sep. 25, 2019 (CN) ..... 201910912625.8

(51) Int. Cl.
*H01Q 1/36* (2006.01)

(52) U.S. Cl.
CPC ..... *H01Q 1/364* (2013.01)

(58) Field of Classification Search
CPC ..... H01Q 1/36; H01Q 1/364; H01Q 1/38; H01Q 21/0006; H01Q 3/00; H01Q 3/36; H01P 9/00; H01P 9/006; G02F 1/13; G02F 1/1313
See application file for complete search history.

(56) References Cited

U.S. PATENT DOCUMENTS

2001/0017577 A1* 8/2001 Toko ..... H01P 1/181 333/161
2002/0075186 A1* 6/2002 Hamada ..... H01Q 1/2283 343/700 MS
2007/0111391 A1 5/2007 Aoki et al.
(Continued)

FOREIGN PATENT DOCUMENTS

CN 1365162 A 8/2002
CN 101305315 A 11/2008
(Continued)

OTHER PUBLICATIONS

State Intellectual Property Office of the People's Republic of China, Office Action and Search Report Issued in Application No. 201910912625.8, dated Jun. 3, 2020, 16 pages. (Submitted with Partial Translation).

*Primary Examiner* — Jason Crawford
(74) *Attorney, Agent, or Firm* — McCoy Russell LLP

(57) ABSTRACT

A liquid crystal antenna includes a first substrate, a second substrate, and liquid crystals arranged between the first substrate and the second substrate. First protrusions and second protrusions are arranged at a surface of the second substrate facing the first substrate, a size of each first protrusion in a first direction is substantially greater than a size of each second protrusion in the first direction, and the first direction is a direction perpendicularly from the second substrate to the first substrate. A run-through labyrinth-type gap is defined by the first protrusions at a surface of the second substrate, and each second protrusion is arranged in the labyrinth-type gap.

15 Claims, 3 Drawing Sheets

(56) References Cited

U.S. PATENT DOCUMENTS

| | | | | |
|---|---|---|---|---|
| 2012/0162047 | A1* | 6/2012 | Mizuno | H01Q 9/42 343/905 |
| 2019/0064609 | A1 | 2/2019 | Haziza | |
| 2019/0123454 | A1* | 4/2019 | Haziza | H01Q 21/065 |
| 2019/0146248 | A1* | 5/2019 | Wang | G02F 1/1313 349/1 |
| 2019/0319325 | A1* | 10/2019 | Zhang | H01Q 3/36 |
| 2020/0343633 | A1* | 10/2020 | Yasuo | H01Q 3/44 |
| 2020/0343635 | A1* | 10/2020 | Hu | G02F 1/13394 |
| 2020/0381810 | A1* | 12/2020 | Sun | H01Q 3/46 |
| 2021/0091460 | A1* | 3/2021 | Liang | H01Q 1/38 |

FOREIGN PATENT DOCUMENTS

| | | | |
|---|---|---|---|
| CN | 108490706 | A | 9/2018 |
| CN | 108615962 | A | 10/2018 |
| CN | 108710232 | A | 10/2018 |
| CN | 108803096 | A | 11/2018 |

* cited by examiner

LIQUID CRYSTAL ANTENNA AND ITS MANUFACTURING METHOD

CROSS-REFERENCE TO RELATED APPLICATION

The present application claims a priority of the Chinese patent application No. 201910912625.8 filed on Sep. 25, 2019, which is incorporated herein by reference in its entirety.

TECHNICAL FIELD

The present disclosure relates to the field of semiconductor technology, in particular to a liquid crystal antenna and its manufacturing method.

BACKGROUND

As a transducer, an antenna is capable of converting a guided wave propagated on a transmission line into an electromagnetic wave propagated in an boundless medium (usually a free space), or vice versa. In the communication field, the antenna is an indispensable part of a communication device.

Currently, there are mainly two types of antennae available in the market, i.e., a mechanical scanning antenna which has such disadvantages as large volume, large weight, high failure rate, slow beam orientation change speed and high maintenance cost, and a phased-array antenna which is manufactured through integrating a microwave Integrated Circuit (IC) into a Printed Circuit Board (PCB) and has such disadvantages as valuableness, complex structure, high power consumption and large heat release. The existing antennae cannot be directly applied to a liquid crystal panel. For, an existing liquid crystal panel antenna (i.e., liquid crystal antenna), a liquid crystal cell needs to have a large thickness, e.g., 100 μm. However, through an existing Thin Film Transistor Liquid Crystal Display (TFT-LCD) manufacture process, it is impossible to form a support structure capable of supporting the liquid crystal cell with a thickness of 100 μm. In addition, due to large thickness of the liquid crystal cell, such a phenomenon as gravity Mura (i.e., various traces on a display panel in the case of non-uniform display brightness for a display device) may easily occur when the display device operates at a high temperature outdoor. In addition, a relatively large space projection area is required in a conventional design, otherwise a large mutual coupling effect may occur, and thereby reception and transmission performance of the liquid crystal antenna may be adversely affected.

SUMMARY

In one aspect, the present disclosure provides in some embodiments a liquid crystal antenna, including a first substrate 100, a second substrate 200, and liquid crystals arranged between the first substrate 100 and the second substrate 200. First protrusions 210 and second protrusions 220 are arranged at a surface of the second substrate 200 facing the first substrate 100, a size of each first protrusion 210 in a first direction is substantially greater than a size of each second protrusion 220 in the first direction, and the first direction is a direction perpendicularly from the second substrate 200 to the first substrate 100. A run-through labyrinth-type gap is defined by the first protrusions 210 at a surface of the second substrate 200, and each second protrusion 220 is arranged in the labyrinth-type gap.

In some possible embodiments of the present disclosure, the run-through labyrinth-type gap refers to a plurality of consecutive zigzag gaps at the surface of the second substrate 200.

In some possible embodiments of the present disclosure, each second protrusion 220 is arranged in the middle of the labyrinth-type gap to divide the labyrinth-type gap into two even parts.

In some possible embodiments of the present disclosure, the run-through labyrinth-type gap is a labyrinth of a specific shape defined by the first protrusions 210 as walls and having interconnected spaces rather than any independent closed region, so as to allow the liquid crystals to flow between the first substrate 100 and the second substrate 200.

In some possible embodiments of the present disclosure, an electrode layer 120 covers a surface of the first substrate 100 facing the second substrate 200.

In some possible embodiments of the present disclosure, a delay line layer 240 covers an outer surface of each second protrusion 220 and is arranged substantially parallel to the electrode layer 120.

In some possible embodiments of the present disclosure, the first substrate 100 is provided with a groove GV having an isosceles-trapezoid-like cross section, and an orthogonal projection of the delay line layer 240 onto the first substrate 100 falls within the groove GV.

In some possible embodiments of the present disclosure, a cross section of the delay line layer 240 in the first direction is of an arc-like shape.

In some possible embodiments of the present disclosure, a cross section of the delay line layer 240 in the first direction is of an isosceles-trapezoid-like shape.

In some possible embodiments of the present disclosure, a metallic shielding layer 250 is arranged at an outer surface of each first protrusion 210.

In some possible embodiments of the present disclosure, one or more support members 230 is uniformly arranged between an upper end surface of the metallic shielding layer 250 and the first substrate 100.

In some possible embodiments of the present disclosure, the first protrusions 210, the second protrusions 220 and the support members 230 are each made of polystyrene.

In some possible embodiments of the present disclosure, a snake-like gap is defined by the first protrusions 210 at the surface of the second substrate 200, and each second protrusion 220 is arranged in a snake-like form in the snake-like gap.

In some possible embodiments of the present disclosure, each support member 230 is of a spherical shape, and a diameter of the support member 230 is smaller than a thickness of the first protrusion 210.

In some possible embodiments of the present disclosure, an insulation layer 110 is arranged on the first substrate 100, and the electrode layer 120 is arranged at a surface of the insulation layer 110 facing the second substrate 200.

In some possible embodiments of the present disclosure, the size of each first protrusion 210 in the first direction is substantially equal to a maximum size of the insulation layer in the first direction, and a ratio of the size of each second protrusion 220 to the size of each first protrusion 210 is not greater than ½.

In another aspect, the present disclosure provides in some embodiments a method for manufacturing a liquid crystal antenna, including: forming an insulation layer at a surface of a first substrate 100, and patterning the insulation layer;

forming the insulation layer at a surface of a second substrate 200, and patterning the insulation layer to form first protrusions 210 and second protrusions 220, a size of each first protrusion 210 in a first direction being substantially greater than a size of each second protrusion 220 in the first direction, the first direction being a direction from the second substrate 200 to the first substrate 100, a run-through labyrinth-type gap being defined by the first protrusions 210 at a surface of the second substrate 200, and each second protrusion 220 being arranged in the labyrinth-type gap; and injecting liquid crystals into between the first substrate 100 and the second substrate 200, and enabling the first substrate 100 and the second substrate 200 to be arranged opposite to each other to form a cell.

In some possible embodiments of the present disclosure, subsequent to patterning the insulation layer on the first substrate 100, the method further includes forming an electrode layer 120 at a surface of the patterned insulation layer. Subsequent to forming the first protrusions 210 and the second protrusions 220, the method further includes forming a delay line layer 240 at a surface of each second protrusion 220.

In some possible embodiments of the present disclosure, subsequent to forming the delay line layer 240 at the surface of each second protrusion 220, the method further includes: forming a metallic shielding layer 250 at an outer surface of each first protrusion 210; and uniformly forming one or more support members 230 at a surface of the metallic shielding layer 250 on an upper end surface of each first protrusion 210.

In some possible embodiments of the present disclosure, the uniformly forming the one or more support members 230 at the surface of the metallic shielding layer 250 on the upper end surface of each first protrusion 210 includes: applying a raw material onto the upper end surface of each first protrusion 210; exposing and curing the raw material in a predefined mode; and developing the raw material to acquire the cured support member 230.

BRIEF DESCRIPTION OF THE DRAWINGS

The above and/or other aspects and advantages of the present disclosure will become more apparent and understandable in conjunction with the following drawings.

REFERENCE SIGN LIST

Figure 1:
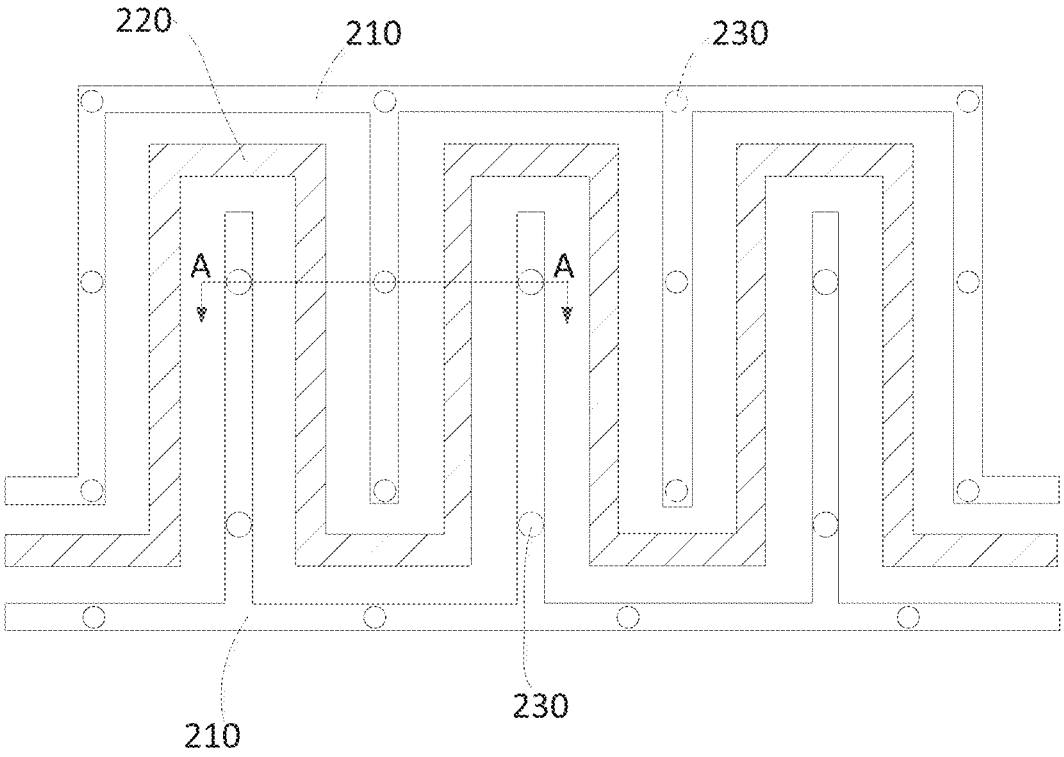
FIG. 1 is a front sectional view of a liquid crystal antenna according to some embodiments of the present disclosure.

100 first substrate
200 second substrate
110 insulation layer
120 electrode layer
130 transmission/reception electrode
210 first protrusion
220 second protrusion
230 support member
240 delay line layer
250 metallic shielding layer

DETAILED DESCRIPTION

The present disclosure will be described hereinafter in conjunction with the embodiments and the drawings. Identical or similar reference numbers in the drawings represent an identical or similar element or elements having an identical or similar function. The following embodiments are for illustrative purposes only, but shall not be used to limit the scope of the present disclosure.

A liquid crystal antenna includes a first substrate 100 and a second substrate 200 arranged opposite to each other. Liquid crystals are injected into a space defined by the first substrate 100 and the second substrate 200, and then the first substrate 100 and the second substrate 200 are arranged opposite to each other to form a liquid crystal cell. A working principle of the liquid crystal antenna will be briefly described as follows. Different voltage signals are applied to control a deflected state of each liquid crystal; when an electromagnetic signal passes through the adjusted liquid crystal cell, it radiates outward via a transmission unit in the liquid crystal cell; and electromagnetic waves are mutually coupled in an external space to form a main beam in a target direction, so as to achieve the transmission of the electromagnetic signal. In addition, when different voltage signals are applied to control the deflected state of each liquid crystal and an external electromagnetic wave passes through the adjusted liquid crystal cell, a signal from the external space is received and transmitted to a reception unit in the liquid crystal cell, so as to achieve the reception of the electromagnetic signal.

For a large-size liquid crystal cell, the liquid crystals may be easily distributed non-uniformly in a large distribution space due to the effect of gravity. For a display panel, such a phenomenon as Mura may easily occur, and for the liquid crystal antenna, the transmission and reception sensitivity of the signal may easily be out of control and adversely affected by temperature.

Figure 2:
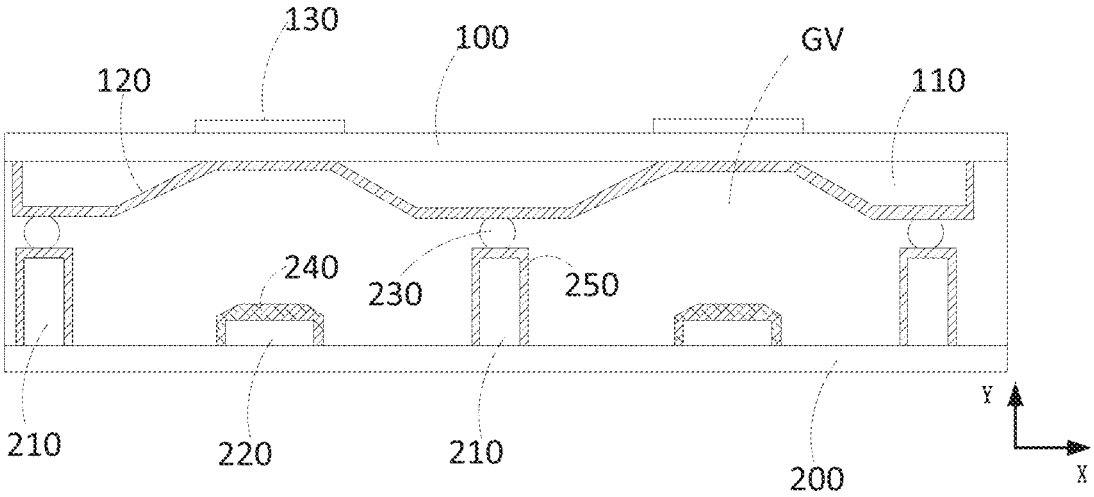
FIG. 2 is a side sectional view of the liquid crystal antenna along line A-A in FIG. 1.

To solve the above problems, the present disclosure provides in some embodiments a liquid crystal antenna which, as shown in FIG. 1 and FIG. 2, includes a first substrate 100, a second substrate 200, and liquid crystals arranged between the first substrate 100 and the second substrate 200. First protrusions 210 and second protrusions 220 are arranged at a surface of the second substrate 200 facing the first substrate 100, a size of each first protrusion 210 in a first direction is substantially greater than a size of each second protrusion 220 in the first direction, and the first direction is a direction perpendicularly from the second substrate 200 to the first substrate 100 (i.e., a direction Y in FIG. 2). As shown in FIG. 1, a run-through labyrinth-type gap may be defined by the first protrusions 210 at a surface of the second substrate 200, and each second protrusion 220 may be arranged in the labyrinth-type gap. Here, it should be appreciated that, the run-through labyrinth-type gap may include a plurality of consecutive zigzag gaps at the surface of the second substrate 200.

Surfaces of the first substrate 100 and the second substrate 200 opposite to each other may each be provided with a specific shape, so as to define a specific gap after the first substrate 100 is arranged opposite to the second substrate 200 to form a cell. Of course, the liquid crystal antenna in the embodiments of the present disclosure may also include any other parts, e.g., a sealant, and a transmitter/receiver (or transmission/reception electrode 130), which are already known to a person skilled in the art and thus will not be particularly defined herein. The above-mentioned first direction (i.e., the direction Y in FIG. 2) may be a vertical direction from an upper end surface of each first protrusion 210 or second protrusion 220 to the second substrate 200, i.e., a height direction of each first protrusion 210 or second protrusion 220. As shown in FIG. 1, the run-through labyrinth-type gap defined by the first protrusions 210 on the second substrate 200 may be a labyrinth of a specific shape defined by the first protrusions 210 as walls and having interconnected spaces rather than any independent closed region, so as to allow the liquid crystals to flow between the first substrate 100 and the second substrate 200. Generally, each second protrusion 220 may be arranged in the middle of the labyrinth-type gap, so as to divide the labyrinth-type gap into two even parts.

According to the liquid crystal antenna in the embodiments of the present disclosure, the second substrate 200 may be provided with the first protrusions 210 and the second protrusions 220, the run-through labyrinth-type gap may be defined by the first protrusions 210, and each second protrusion 220 may be arranged in the labyrinth-type gap. After the first substrate 100 has been arranged opposite to the second substrate 200 to form the liquid crystal antenna, the flow of the liquid crystals in the labyrinth-type gap may be limited to the greatest extent, so it is able to prevent the liquid crystals from being distributed non-uniformly due to the gravity even at a high temperature outdoor, thereby to reduce a signal loss and provide the liquid crystal antenna with stable signal reception/transmission performance.

In some possible embodiments of the present disclosure, as shown in FIG. 1 and FIG. 2, an electrode layer 120 may cover a surface of the first substrate 100 facing the second substrate 200, and a delay line layer 240 may cover an outer surface of each second protrusion 220 and may be arranged substantially parallel to the electrode layer 120. A delay line in the delay line layer 240 is capable of delaying an electric signal by a certain time period. In the embodiments of the present disclosure, when the delay line layer 240 is arranged substantially parallel to the electrode layer 120, it means that the delay line layer 240 may be spaced apart by a certain distance from the electrode layer 120 and the distance remains substantially the same at different positions of the delay line layer 240 and the electrode layer 120. In this way, it is able to ensure a uniform electric field between the electrode layer 120 and the delay line layer 240, and enable the liquid crystals to be distributed uniformly between the electrode layer 120 and the delay line layer 240, thereby to further reduce the signal loss.

In some possible embodiments of the present disclosure, as shown in FIG. 2, the first substrate 100 may be provided with a groove GV having an isosceles-trapezoid-like cross section, and an orthogonal projection of the delay line layer 240 onto the first substrate 100 may fall within the groove GV. In actual use, usually a cross section of the delay line layer 240 in the direction Y may be of an arc-like or isosceles-trapezoid-like shape. To ensure an equal distance between the electrode layer 120 and the delay line layer 240, the groove GV having the isosceles-trapezoid-like shape may be formed in the first groove 100 at a position corresponding to the delay line layer 240, and the delay line layer 240 may be arranged substantially parallel to a corresponding inner wall of the groove GV having the isosceles-trapezoid-like shape. Of course, it should be appreciated that, the shape of the cross section of the delay line layer 240 in the direction Y may not be limited to be arc or isosceles trapezoid, and it may also be any other special shapes according to the practical needs, which will not be particularly defined herein.

In some possible embodiments of the present disclosure, as shown in FIG. 2, a metallic shielding layer 250 may be arranged at an outer surface of each first protrusion 210, and one or more support members 230 in the shape of beads may be arranged between an upper end surface of the metallic shielding layer 250 and the first substrate 100. Although, for convenience, merely one support member 230 is shown in FIG. 2 between the upper end surface of the metallic shielding layer 250 and the first substrate 100, a plurality of support members 230 may also be arranged uniformly between the upper end surface of the metallic shielding layer 250 and the first substrate 100. Each first protrusion 210 may be arranged close to the first substrate 100, and when the support member 230 is arranged at the upper end surface of the first protrusion 210, the first protrusion 210 may indirectly abut against the first substrate 100, so as to provide the liquid crystal cell with a stable structure, and further facilitate the flow of the liquid crystals in the liquid crystal cell. In addition, the support member 230 is of a small particle size, so it is able to prevent the liquid crystals from being adversely affected by gravity, thereby to ensure the uniform distribution of the liquid crystals in the liquid crystal cell. When the metallic shielding layer 250 covers the outer surface of each first protrusion 210, it is able to relieve the mutual coupling effect between the delay line layers 240, thereby to further improve the performance of the liquid crystal antenna.

In some possible embodiments of the present disclosure, there may also exist some implementation details. As shown in FIG. 1, a snake-like gap may be defined by the first protrusions 210 at the surface of the second substrate 200, and each second protrusion 220 may be arranged in a snake-like form in the snake-like gap. The first protrusions 210, the second protrusions 220 and the support members 230 may each be made of polystyrene (PS). The snake-like gap is of a relatively simple structure and its manufacturing process is not complex, so it is able to reduce the manufacture cost.

In some possible embodiments of the present disclosure, as shown in FIG. 2, an insulation layer 110 may be arranged on the first substrate 100, and the electrode layer 120 may be arranged at a surface of the insulation layer 110 facing the second substrate 200. The size of each first protrusion 210 in the first direction (i.e., the direction Y in FIG. 2) may be substantially equal to a maximum size of the insulation layer 110 in the first direction, and a ratio of the size of each second protrusion 220 to the size of each first protrusion 210 may be not greater than ½. In addition, the support member 230 may be of a spherical shape, and a diameter of the support member 230 may be smaller than a thickness of the first protrusion 210.

Actually, the liquid crystal cell of the liquid crystal antenna usually includes the insulation layer 110, and the insulation layer 110 may be arranged on both the first substrate 100 and the second substrate 200. For example, the above-mentioned groove having the isosceles-trapezoid-like cross section may be formed through the insulation layer 110, or the first protrusions 210 and the second protrusions 220 on the second substrate 200 as shown in FIG. 1 and FIG. 2. Usually, the insulation layer may be made of an organic material. In some possible embodiments of the present disclosure, the electrode layer 120 may also cover each first protrusion 210, and the delay line layer 240 may cover the outer surface of each second protrusion 220. In the actual liquid crystal antenna, an alignment layer may be arranged at a surface of each of the electrode layer 120 and the delay line layer 240 in contact with the liquid crystals. The alignment layer may be made of a high-molecular polymer, so as to enable liquid crystal molecules to be arranged regularly. The commonly-used high-molecular polymer may include PS and polyimide (PI). In addition, the transmission/reception electrode 130 of the liquid crystal antenna may be electrically connected to the electrode layer 120 in the liquid crystal cell.

For different liquid crystal antennae, the sizes of the first protrusions 210 and the second protrusions 220 may be different. For example, when the insulation layer 110 on the first substrate 100 has a thickness of 20 to 50 μm, a height of each first protrusion 210 may be within the range of 20 to 50 μm, and a height of each second protrusion 220 may be within the range of 1 to 30 μm. A width of each first protrusion 210 may be within the range of 50 to 100 μm, and a width of the delay line layer 240 may be within the range of 10 to 200 μm. In addition, in the embodiments of the present disclosure, such an expression as "within the range of c to dμm" represents that c and d are included in the range, where c and d are each a real number.

Figure 3:
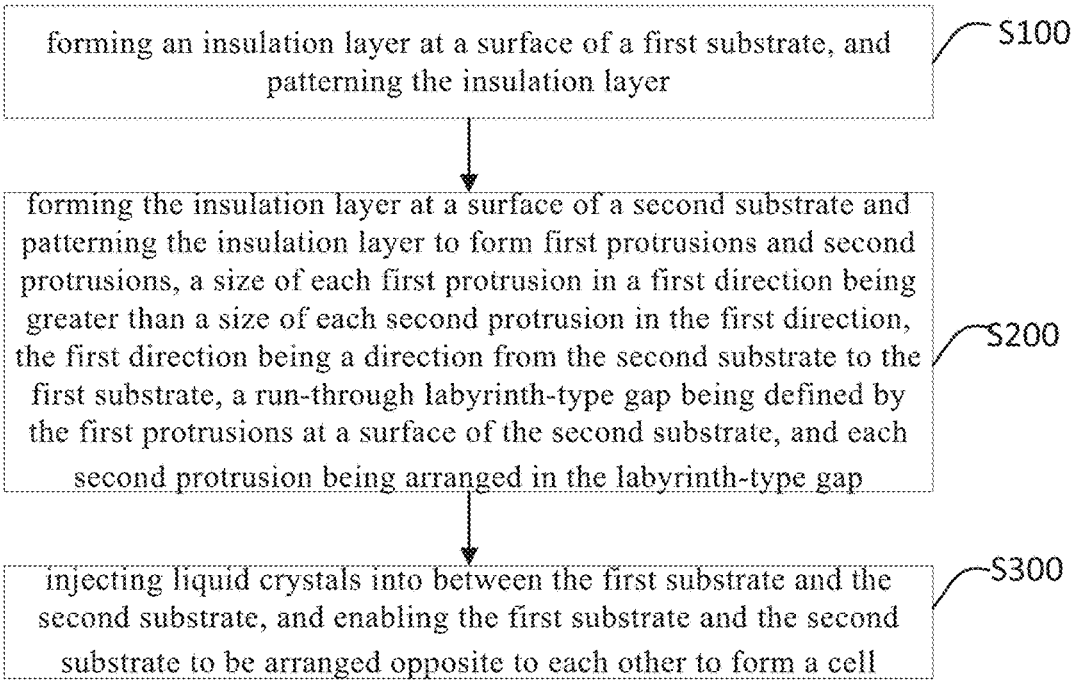
FIG. 3 is a flow chart of a method for manufacturing the liquid crystal antenna according to some embodiments of the present disclosure.

The present disclosure further provides in some embodiments a method for manufacturing a liquid crystal antenna which, as shown in FIG. 3, includes the following steps.

S100: forming an insulation layer 110 at a surface of a first substrate 100, and patterning the insulation layer 110.

The so-called patterning may refer to the processing of a specific material layer to form a specific pattern structure, and it may include exposing, developing and etching. Based on a design requirement, the insulation layer 110 may be formed on the first substrate 100, and then patterned to provide a special structure of the insulation layer 110.

S200: forming the insulation layer 110 at a surface of a second substrate 200 and patterning the insulation layer 110 to form first protrusions 210 and second protrusions 220. A size of each first protrusion 210 in a first direction (i.e., the direction Y in FIG. 2) may be substantially greater than a size of each second protrusion 220 in the first direction, the first direction may be a direction perpendicularly from the second substrate 200 to the first substrate 100, a run-through labyrinth-type gap may be defined by the first protrusions 210 at a surface of the second substrate 200, and each second protrusion 220 may be arranged in the labyrinth-type gap.

Identically, the insulation layer 110 may also be formed on the second substrate 200, and then patterned to form the first protrusions 210 and the second protrusions 220 each of a predetermined shape, so that the run-through labyrinth-type gap may be defined by the first protrusions 210 at the surface of the second substrate 200 and each second protrusion 220 may be arranged in the labyrinth-type gap. In some possible embodiments of the present disclosure, the labyrinth-type gap may be a snake-like gap, and each second protrusion 220 may be arranged in a snake-like form in the snake-like gap.

S300: injecting liquid crystals into between the first substrate 100 and the second substrate 200, and enabling the first substrate 100 and the second substrate 200 to be arranged opposite to each other to form a cell.

After the liquid crystals have been injected, the first substrate 100 and the second substrate 200 may be arranged opposite to each other to form a complete liquid crystal cell as soon as possible, so as to prevent the liquid crystals from being polluted, and prevent a sealant between the first substrate 100 and the second substrate 200 from being cured at a room temperature.

According to the embodiments of the present disclosure, the above-mentioned liquid crystal antenna may be manufactured using the method. In the liquid crystal antenna, the second substrate 200 may be provided with the first protrusions 210 and the second protrusions 220, the run-through labyrinth-type gap may be defined by the first protrusions 210, and each second protrusion 220 may be arranged in the labyrinth-type gap. After the first substrate 100 has been arranged opposite to the second substrate 200 to form the liquid crystal antenna, the flow of the liquid crystals in the labyrinth-type gap may be limited to the greatest extent, so it is able to prevent the liquid crystals from being distributed non-uniformly due to the gravity even at a high temperature outdoor, thereby to reduce a signal loss and provide the liquid crystal antenna with stable signal reception/transmission performance.

In some possible embodiments of the present disclosure, subsequent to patterning the insulation layer 110 on the first substrate 100, the method may further include forming an electrode layer 120 at a surface of the patterned insulation layer 110. Subsequent to forming the first protrusions 210 and the second protrusions 220, the method may further include forming a delay line layer 240 at a surface of each second protrusion 220. In the actual manufacture process, usually a PI film may be coated onto the electrode layer 120 and the delay line layer 240, and then aligned using a photo-induced alignment technology.

In some possible embodiments of the present disclosure, subsequent to forming the delay line layer 240 at the surface of each second protrusion 220, the method may further include: forming a metallic shielding layer 250 at an outer surface of each first protrusion 210; and uniformly forming one or more support members at the surface of the metallic shielding layer 250 on an upper end surface of each first protrusion 210.

In some possible embodiments of the present disclosure, the uniformly forming the one or more support members at the surface of the metallic shielding layer 250 on the upper end surface of each first protrusion 210 may include: applying a raw material onto the upper end surface of each first protrusion 210; exposing and curing the raw material in a predefined mode; and developing the raw material to acquire the cured support member 230.

A specific mode for forming the support member 230 has been provided in the embodiments of the present disclosure. The support member 230 may be a PS microsphere having a particle size of about 50 to 80 μm. A PS microsphere@organic solution (a raw material for the support member 230, where @ represents that the PS microspheres are dispersed in the organic solution) may be spread onto the second substrate 200 through spin coating, and then exposed to cure the raw material at an exposed region, so as to fix the PS microsphere at a top of each first protrusion 210. Then, the raw material may be developed, and an unexposed region may be washed, so as to remove the PS microspheres off from the second substrate 200. Alternatively, the PS microsphere may be formed at a fixed position through printing.

In some possible embodiments of the present disclosure, the patterning the insulation layer 110 on the first substrate 100 may include patterning the insulation layer 110 on the first substrate 100 to form a groove having an isosceles-trapezoid-like cross section. After the delay line layer 240 has been formed at the surface of each second protrusion 220, the delay line layer 240 may be substantially parallel to an inner wall of the groove.

Figure 4:
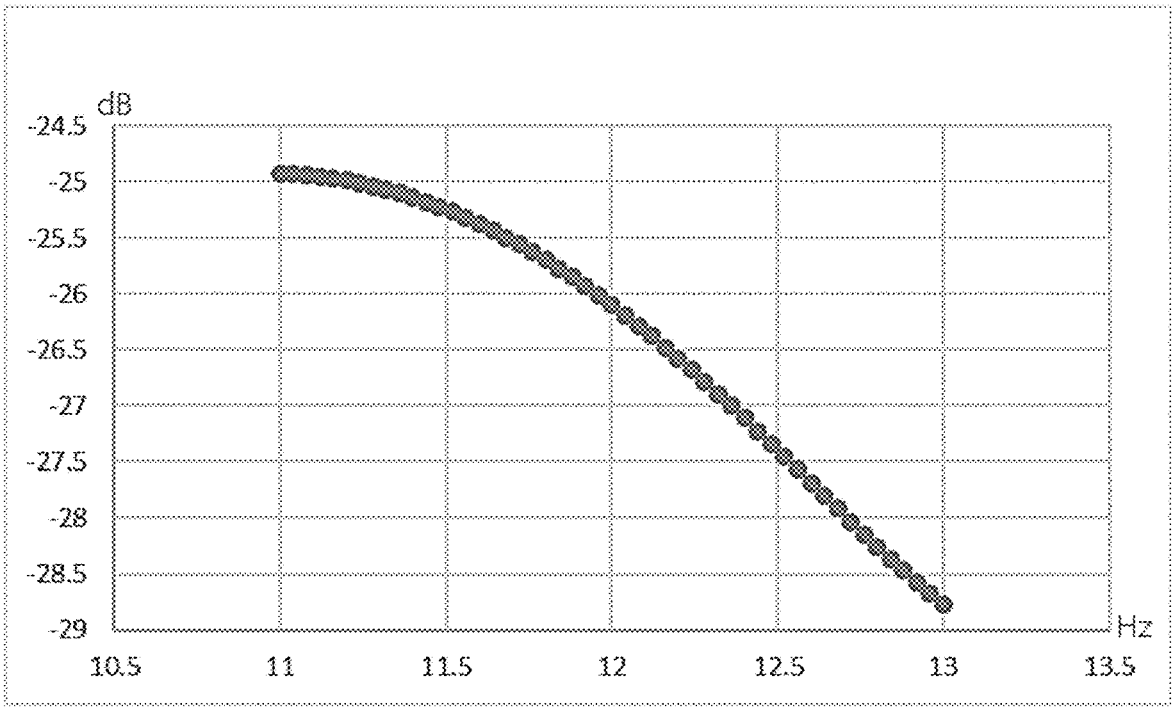
FIG. 4 is a diagram showing port loss of the liquid crystal antenna according to some embodiments of the present disclosure.
Figure 5:
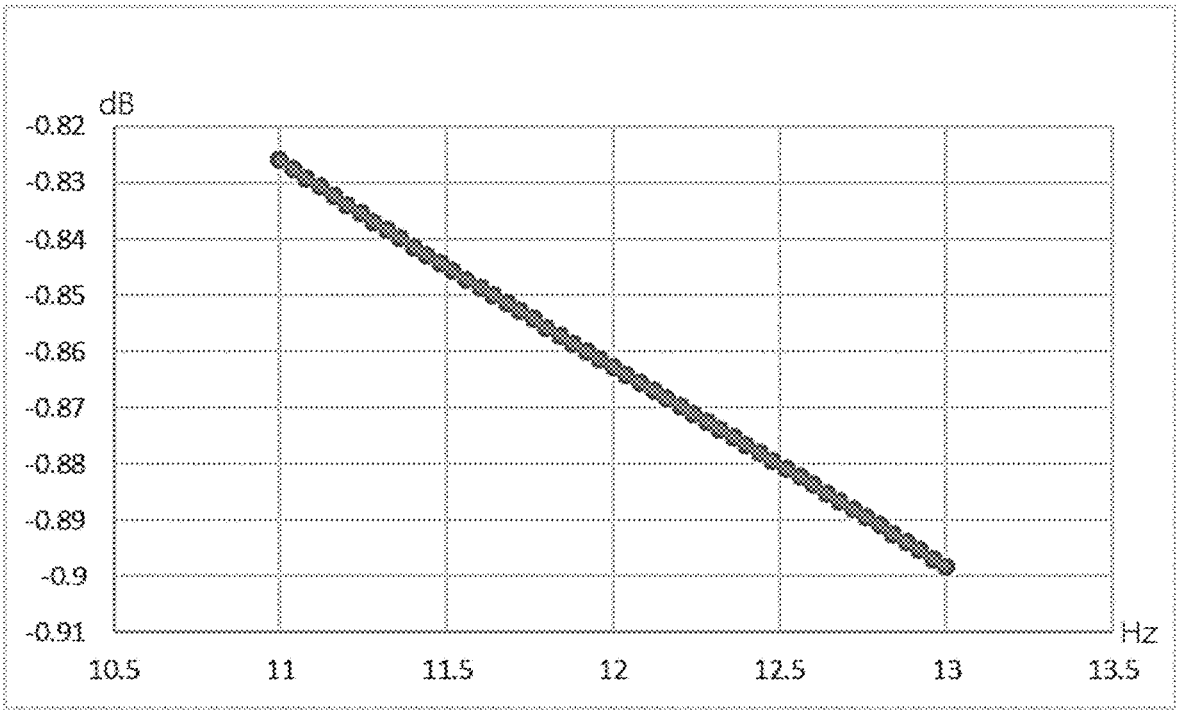
FIG. 5 is a diagram showing insertion loss of the liquid crystal antenna according to some embodiments of the present disclosure.

The beneficial effect of the liquid crystal antenna acquired through the above steps may refer to that mentioned hereinabove. Through testing the liquid crystal antenna, as shown in FIG. 4 (in FIG. 4, a horizontal axis represents frequency with a unit of Hz and a longitudinal axis represents S11 (a port loss)), the port loss linearly changes from −25 dB to −28.5 dB, i.e., a difference is smaller than −10 dB, so the port loss may meet the engineering requirement. As shown in FIG. 5 (in FIG. 5, a horizontal axis represents frequency, and a longitudinal axis represents S21 (an insertion loss)), the insertion loss linearly changes from about −0.825 dB to about −0.9 dB, so the insertion loss may approximately meet the current engineering requirement. In a word, as shown in FIG. 4 and FIG. 5, it is able for the liquid crystal antenna in the embodiments of the present disclosure to sufficiently meet the engineering requirement on the signal loss.

It should be appreciated that, steps, measures and schemes in various operations, methods and processes that have already been discussed in the embodiments of the present disclosure may be replaced, modified, combined or deleted. In some possible embodiments of the present disclosure, the other steps, measures and schemes in various operations, methods and processes that have already been discussed in the embodiments of the present disclosure may also be replaced, modified, rearranged, decomposed, combined or deleted. In another possible embodiment of the present disclosure, steps, measures and schemes in various operations, methods and processes that are known in the related art and have already been discussed in the embodiments of the present disclosure may also be replaced, modified, rearranged, decomposed, combined or deleted.

It should be further appreciated that, such words as "center", "on", "under", "front", "back", "left", "right", "vertical", "horizontal", "top", "bottom", "inner" and "outer" are used to indicate directions or positions as viewed in the drawings, and they are merely used to facilitate the description in the present disclosure, rather than to indicate or imply that a device or member must be arranged or operated at a specific position.

In addition, such words as "first" and "second" may merely be adopted to differentiate different features rather than to implicitly or explicitly indicate any number or importance, i.e., they may be adopted to implicitly or explicitly indicate that there is at least one said feature. Further, such a phrase as "a plurality of" may be adopted to indicate that there are two or more features, unless otherwise specified.

Unless otherwise specified, such words as "arrange" and "connect" may have a general meaning, e.g., the word "connect" may refer to fixed connection, removable connection or integral connection, or mechanical or electrical connection, or direct connection or indirect connection via an intermediate component, or communication between two components, or wired or wireless communication connection. The meanings of these words may be understood by a person skilled in the art in accordance with the practical need.

In the above description, the features, structures, materials or characteristics may be combined in any embodiment or embodiments in an appropriate manner.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

The invention claimed is:

1. A liquid crystal antenna, comprising: a first substrate, a second substrate, and liquid crystals arranged between the first substrate and the second substrate, wherein first protrusions and second protrusions are arranged at a surface of the second substrate facing the first substrate, a size of each first protrusion in a first direction is substantially greater than a size of each second protrusion in the first direction, and the first direction is a direction perpendicularly from the second substrate to the first substrate, and wherein a run-through labyrinth-type gap is defined by the first protrusions at a surface of the second substrate, and each second protrusion is arranged in the labyrinth-type gap, wherein a metallic shielding layer is arranged at an outer surface of each first protrusion.

2. The liquid crystal antenna according to claim 1, wherein the run-through labyrinth-type gap refers to a plurality of consecutive zigzag gaps at the surface of the second substrate.

3. The liquid crystal antenna according to claim 1, wherein each second protrusion is arranged in the middle of the labyrinth-type gap to divide the labyrinth-type gap into two even parts.

4. The liquid crystal antenna according to claim 1, wherein the run-through labyrinth-type gap is a labyrinth of a specific shape defined by the first protrusions as walls and having interconnected spaces rather than any independent closed region, so as to allow the liquid crystals to flow between the first substrate and the second substrate.

5. The liquid crystal antenna according to claim 1, wherein an electrode layer covers a surface of the first substrate facing the second substrate.

6. The liquid crystal antenna according to claim 5, wherein a delay line layer covers an outer surface of each second protrusion and is arranged substantially parallel to the electrode layer.

7. The liquid crystal antenna according to claim 6, wherein the first substrate is provided with a groove having an isosceles-trapezoid-like cross section, and an orthogonal projection of the delay line layer onto the first substrate falls within the groove.

8. The liquid crystal antenna according to claim 6, wherein a cross section of the delay line layer in the first direction is of an arc-like shape.

9. The liquid crystal antenna according to claim 6, wherein a cross section of the delay line layer in the first direction is of an isosceles-trapezoid-like shape.

10. The liquid crystal antenna according to claim 5, wherein an insulation layer is arranged on the first substrate, and the electrode layer is arranged at a surface of the insulation layer facing the second substrate.

11. The liquid crystal antenna according to claim 10, wherein the size of each first protrusion in the first direction is substantially equal to a maximum size of the insulation layer in the first direction, and a ratio of the size of each second protrusion to the size of each first protrusion in the first direction is not greater than ½.

12. The liquid crystal antenna according to claim 1, wherein one or more support members is uniformly arranged between an upper end surface of the metallic shielding layer and the first substrate.

13. The liquid crystal antenna according to claim 12, wherein the first protrusions, the second protrusions and the support members are each made of polystyrene.

14. The liquid crystal antenna according to claim 12, wherein each support member is of a spherical shape, and a diameter of the support member is smaller than a thickness of the first protrusion.

15. The liquid crystal antenna according to claim 1, wherein a snake-like gap is defined by the first protrusions at the surface of the second substrate, and each second protrusion is arranged in a snake-like form in the snake-like gap.

* * * * *